US008657278B2

(12) United States Patent
Ozeki et al.

(10) Patent No.: US 8,657,278 B2
(45) Date of Patent: Feb. 25, 2014

(54) IMAGE FORMING APPARATUS

(75) Inventors: Naoto Ozeki, Kohnan (JP); Masamitsu Ukai, Nagoya (JP); Atsushi Mikuni, Nagoya (JP); Wei Ming Wang, Toyoake (JP); Tomitake Aratachi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/432,328

(22) Filed: Mar. 28, 2012

(65) Prior Publication Data

US 2013/0001855 A1 Jan. 3, 2013

(30) Foreign Application Priority Data

Jun. 29, 2011 (JP) ..... 2011-144592

(51) Int. Cl.
*B65H 5/00* (2006.01)

(52) U.S. Cl.
USPC ..... 271/10.13; 271/9.11; 271/10.04; 271/4.04; 399/110; 399/107; 399/391; 399/393

(58) Field of Classification Search
USPC ..... 271/9.01, 9.11, 10.04, 10.13, 4.04, 162, 271/164, 145; 399/391, 393, 107, 110
See application file for complete search history.

(56) References Cited

U.S. PATENT DOCUMENTS 4,958,822 A * 9/1990 Rutishauser et al. ..... 271/9.11
5,002,266 A * 3/1991 Kikuchi et al. ..... 271/3.2
5,191,382 A 3/1993 Okamura et al.
5,443,252 A * 8/1995 Morinaga et al. ..... 271/127
5,485,990 A * 1/1996 Kato ..... 271/9.08
5,641,154 A * 6/1997 Gysling et al. ..... 271/9.01
5,878,308 A 3/1999 Kurata et al.
6,032,942 A * 3/2000 Cho ..... 271/9.11
6,056,285 A * 5/2000 Kikuta et al. ..... 271/118
6,381,429 B1 4/2002 Shibata et al.
6,382,623 B1 * 5/2002 Gibson ..... 271/157
6,994,483 B2 * 2/2006 Jang ..... 400/629
7,273,211 B2 * 9/2007 Yanagida ..... 271/3.14

(Continued)

FOREIGN PATENT DOCUMENTS

JP 04-323122 11/1992
JP H04323132 A 11/1992

(Continued)

OTHER PUBLICATIONS

Notification of Reasons for Rejection mailed Apr. 9, 2013 in Japanese Application No. 2011-144592 and English translation thereof.

*Primary Examiner* — Prasad Gokhale
(74) *Attorney, Agent, or Firm* — Banner & Witcoff, Ltd.

(57) ABSTRACT

An image forming apparatus may include a first tray configured to accommodate one or more recording sheets to be supplied to an image forming unit, a body frame configured to position an upper part of the first tray, and an expansion members disposed under the body frame to position a lower part of the first tray. The expansion member may include a transmission mechanism configured to be engagable with a body-side gear provided in the body frame. The transmission mechanism may be configured to transmit a drive force, which is transmitted from a drive source provided in the body frame via the body-side gear, to an add-on mechanism, when the transmission mechanism is engaged with the body-side gear.

11 Claims, 9 Drawing Sheets

(56) References Cited

U.S. PATENT DOCUMENTS

| | | | | |
|---|---|---|---|---|
| 2003/0025263 | A1* | 2/2003 | Koga | 271/9.12 |
| 2009/0220275 | A1 | 9/2009 | Hashimoto | |
| 2013/0001854 | A1* | 1/2013 | Ukai et al. | 271/9.01 |

FOREIGN PATENT DOCUMENTS

| | | | |
|---|---|---|---|
| JP | 05-119404 | | 5/1993 |
| JP | H07137853 | A | 5/1995 |
| JP | H0873074 | A | 3/1996 |
| JP | 10-120203 | | 5/1998 |
| JP | H10329959 | A | 12/1998 |
| JP | 2000-251347 | | 9/2000 |
| JP | 2001-248656 | A | 9/2001 |
| JP | 2002-104679 | A | 4/2002 |
| JP | 2002-332127 | A | 11/2002 |
| JP | 2003-020131 | | 1/2003 |
| JP | 2003-076249 | A | 3/2003 |
| JP | 2004-361719 | A | 12/2004 |
| JP | 2009-210630 | A | 9/2009 |

* cited by examiner

IMAGE FORMING APPARATUS

CROSS REFERENCE TO RELATED APPLICATION

This application claims priority from Japanese Patent Application No. 2011-144592, filed on Jun. 29, 2011, the entire subject matter of which is incorporated herein by reference.

TECHNICAL FIELD

One or more aspects of the invention relate to an image forming apparatus configured such that an expansion member is provided in a lower part of a main body of the image forming apparatus to attach a large-capacity sheet feed tray to the main body.

BACKGROUND

A known image forming apparatus includes a main body having a space for a standard-capacity sheet feed tray. In the known image forming apparatus, one or more expansion members are attachable to a lower part of the main body. When the space is expanded by the one or more expansion members, a larger-capacity sheet feed tray can be attached to the main body.

SUMMARY

In recent years, for example, there is a demand that an add-on sheet feeder, which is configured to feed a sheet therefrom to an image forming portion in the main body, is added to the main body of the image forming apparatus, under the expansion members. However, if another motor is provided to the add-on sheet feeder separately from a motor provided in the main body, this may increase costs.

An embodiment provides for an image forming apparatus in which an add-on mechanism, which is provided under one or more expansion members, and a mechanism, which is provided in a main body, are driven by a common motor (referred to herein as a "drive source").

An image forming apparatus may include a first tray, one or more body frames, and one or more expansion members. The first tray may be configured to accommodate one or more recording sheets to be supplied to an image forming unit. The body frame or body frames may be configured to partially surround and/or sandwich therebetween an upper part of the first tray. One or more of the expansion members may be disposed under the body frames to partially surround and/or sandwich therebetween a lower part of the first tray. One of the expansion members may include a transmission mechanism configured to be engagable with a body-side gear provided in one of the body frames. The transmission mechanism may be configured to transmit a drive force, which is transmitted from a drive source provided in one of the body frames via the body-side gear, to an add-on mechanism, which is attached under the expansion members, when the transmission mechanism is engaged with the body-side gear.

According to one embodiment, the drive force from the drive source provided in the one of the body frames may be transmitted to the add-on mechanism via the body-side gear and the transmission mechanism of the one of the expansion members when the add-on mechanism, e.g., sheet feeder, is attached under the expansion members. Therefore, the mechanism provided in the one of the body frames and the add-on mechanism may be driven by the common drive source.

According to one or more aspects of the invention, the add-on mechanism disposed under the expansion members and the mechanism provided in the one of the body frames may be driven by the common drive source.

BRIEF DESCRIPTION OF THE DRAWINGS

Illustrative aspects will be described in detail with reference to the following figures in which like elements are labeled with like numbers and in which.

DETAILED DESCRIPTION

An embodiment will be described in detail with reference to the accompanying drawings. First, an overall configuration of a common laser printer 1 will be described. Then, a laser printer 100, e.g., an image forming apparatus, according to the invention will be described in detail.

Figure 1:
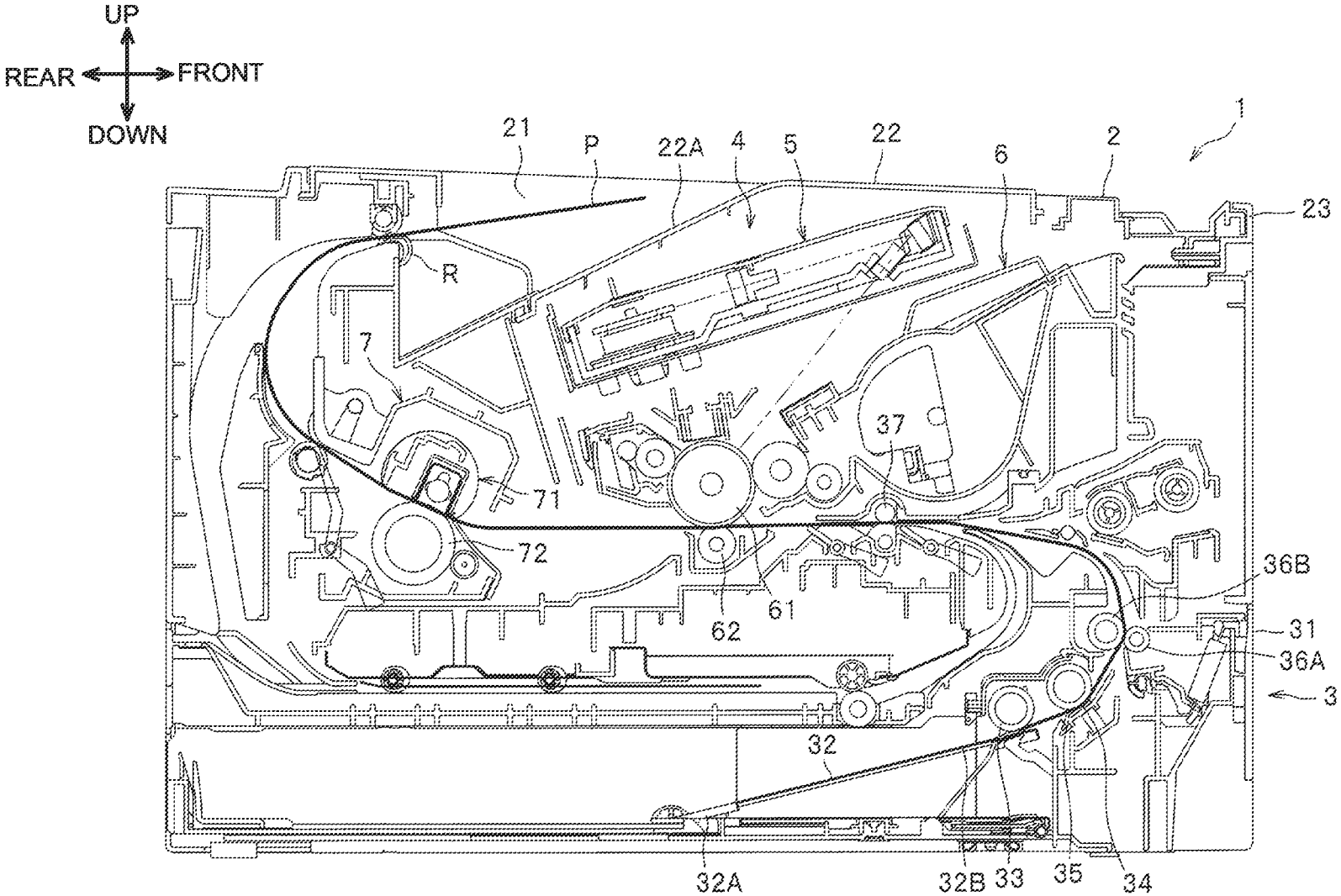
FIG. 1 is a vertical sectional view showing a laser printer to which a smaller-capacity sheet feed tray is attached.

In the description below, orientations of the laser printers 1, 100 are defined when each of the laser printers 1, 100 is disposed in an orientation in which it is intended to be used by a user. That is, the right in FIG. 1 is referred to as the front (near side) of the laser printer 1, the left in FIG. 1 is referred to as the rear (far side) of the laser printer 1, the far side in FIG. 1 is referred to as the right of the laser printer 1, and the near side in FIG. 1 is referred to as the left of the laser printer 1. An up-down direction along the surface of the drawing sheet of FIG. 1 is referred to as an up-down direction in the laser printer 1. These direction and orientations are also applied to similar drawings among the accompanying drawings.

As shown in FIG. 1, the laser printer 1 comprises a main body 2, a feeder unit 3, and an image forming unit 4. The feeder unit 3 is configured to feed a sheet P, e.g., recording sheet, to the image forming unit 4. The image forming unit 4 is configured to form an image onto the sheet P.

The main body 2 comprises a pair of right and left body frames 21, a top panel 22, and a front cover 23. The top panel 22 is disposed between the body frames 21 to connect upper portions of the body frames 21 with each other. The front cover 23 is configured to be pivotable with respect to the body frames 21. The top panel 22 comprises a sheet discharge tray 22A which is configured to hold one or more sheets P to be discharged to the outside of the main body 2.

The feeder unit 3 is disposed in a lower part of the main body 2 and comprises a sheet feed tray 31 and a pressing plate 32. The sheet feed tray 31 is configured to be attachable to and detachable from the main body 2 from the front of the laser printer 1. The pressing plate 32 is disposed in the sheet feed tray 31. The feeder unit 3 further comprises a feed roller 33, a separation roller 34, and a separation pad 35. The feed roller 33 is disposed above leading edges of sheets P stacked in the sheet feed tray 31. The separation roller 34 and the separation pad 35 are disposed downstream of the feed roller 33 in a conveying direction of the sheet P. The feed roller 33 and the separation roller 34 are supported by a single support member (to which a reference numeral is not assigned) and configured to be rotatable independently.

The support member is configured to pivotable about the separation roller 34 such that the feed roller 33 is movable with respect to the separating roller 34. The pressing plate 32 is supported by the sheet feed tray 31 such that the pressing plate 32 is pivotable about a rear end 32A of the pressing plate 32 and a front end 32B of the pressing plate 32 moves toward and away from the feed roller 33. The feeder unit 3 further comprises a paper dust removing roller 36A, a conveyor roller 36B, and a pair of registration rollers 37. The paper dust removing roller 36A is disposed downstream of the separation roller 34 in the conveying direction. The conveyor roller 36B is disposed facing the paper dust removing roller 36A. The pair of registration rollers 37 is disposed downstream of the paper dust removing roller 36A in the conveying direction.

The sheet feed tray 31 is configured to be attachable to and detachable from the pair of the body frames 21 in a front-rear direction. The feed roller 33, the separation roller 34, and the conveyor roller 36B are held by the main body 2. The separation pad 35 and the paper dust removing roller 36A are held by the sheet feed tray 31. Therefore, when the sheet feed tray 31 is drawn toward the front, the separation roller 34 and the paper dust removing roller 36A are disengaged from the separation pad 35 and the conveyor roller 36B, respectively.

In the feeder unit 3 configured as described above, one or more sheet P are pressed against the feed roller 33 by the pivoting of the pressing plate 32 and are fed by the feed roller 33. The fed one or more sheets P are then separated one by one by the separation roller 33 and the separation pad 35 and are conveyed to the image forming unit 4 successively through the conveyor roller 36B and the pair of registration rollers 37.

The image forming unit 4 comprises a scanner unit 5 and a process cartridge 6, and a fixing unit 7.

The scanner unit 5 is disposed in an upper part of the main body 2 and comprises a laser-emitting portion (not shown), a polygon mirror, lens and reflectors (to which reference numerals are not assigned). The scanner unit 5 is configured to irradiate a surface of a photosensitive drum 61 with a laser beam by high-speed scanning.

The process cartridge 6 is configured to be attachable to and detachable from the main body 2 through an opening that appears by the opening of the front cover 23. The process cartridge 6 comprises a photosensitive drum 61, a transfer roller 62, a charger, a developing roller, a layer-thickness regulating blade, and a toner chamber (to which reference numerals are not assigned).

In the process cartridge 6, the charger uniformly charges the surface of the rotating photosensitive drum 61. Then, the scanner unit 5 exposes the surface of the photosensitive drum 61 with a laser beam by the high-speed scanning. Thus, a potential of the exposed portion to which the laser beam is irradiated becomes lowered and an electrostatic latent image is formed on the surface of the photosensitive drum 61 based on image data.

Then, the developing roller supplies the electrostatic latent image formed on the photosensitive drum 61 with toner from the toner chamber to form a toner image on the surface of the photosensitive drum 61. After that, while the sheet P passes between the photosensitive drum 61 and the transfer roller 62, the toner image formed on the photosensitive drum 61 is transferred onto the sheet P.

The fixing unit 7 comprises a heating unit 71 and a pressing roller 72. The heating unit 71 comprises, for example, a halogen heater, a fixing film, and a nip plate (to which reference numerals are not assigned). The pressing roller 72 is configured to nip the fixing film between the heating unit 71 and the nip plate. In the fixing unit 7 configured as described above, the toner transferred onto the sheet P is fixed on the sheet P by heat while the sheet P passes between the heating unit 71 and the pressing roller 72.

Then, the sheet P, on which the toner has been thermally fixed by the fixing unit 7, is conveyed to a sheet discharge roller R. The sheet discharge roller R is disposed downstream of the fixing unit 7 in the conveying direction. The sheet P is further conveyed by the sheet discharge roller R and is discharged onto the sheet discharge tray 22A.

Figure 2:
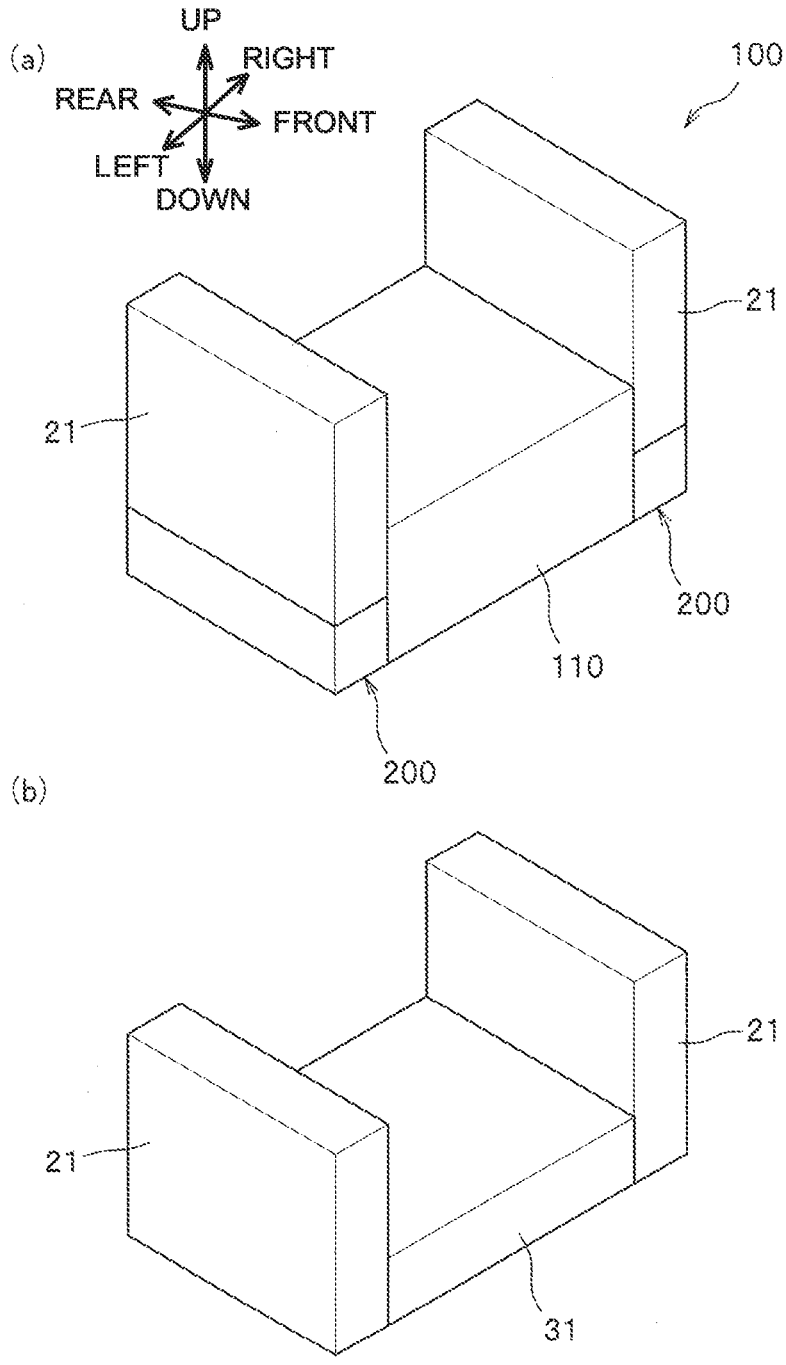
FIG. 2A is a simplified perspective view of a laser printer to which a larger-capacity sheet feed tray is attached.
FIG. 2B is a simplified perspective view of the laser printer of FIG. 1 to which the smaller-capacity sheet feed tray is attached.

Hereinafter, the laser printer 100 according to the invention will be descried. As shown in FIG. 2A, the laser printer 100 comprises a pair of expansion members 200, which is disposed under the pair of body frames 21. The pair of expansion members 200 allows a larger-capacity sheet feed tray 110, e.g., first tray, to be attached to the laser printer 100, instead of the sheet feed tray 31 which is attached to the laser printer 1 (see FIG. 2B). The larger-capacity sheet feed tray 110 is larger in size than the sheet feed tray 31. The pair of expansion members 200 is attached under the pair of the body frames 21 to expand the space for the sheet feed tray 31 large enough to accommodate the larger-capacity sheet feed tray 110.

Figure 3:
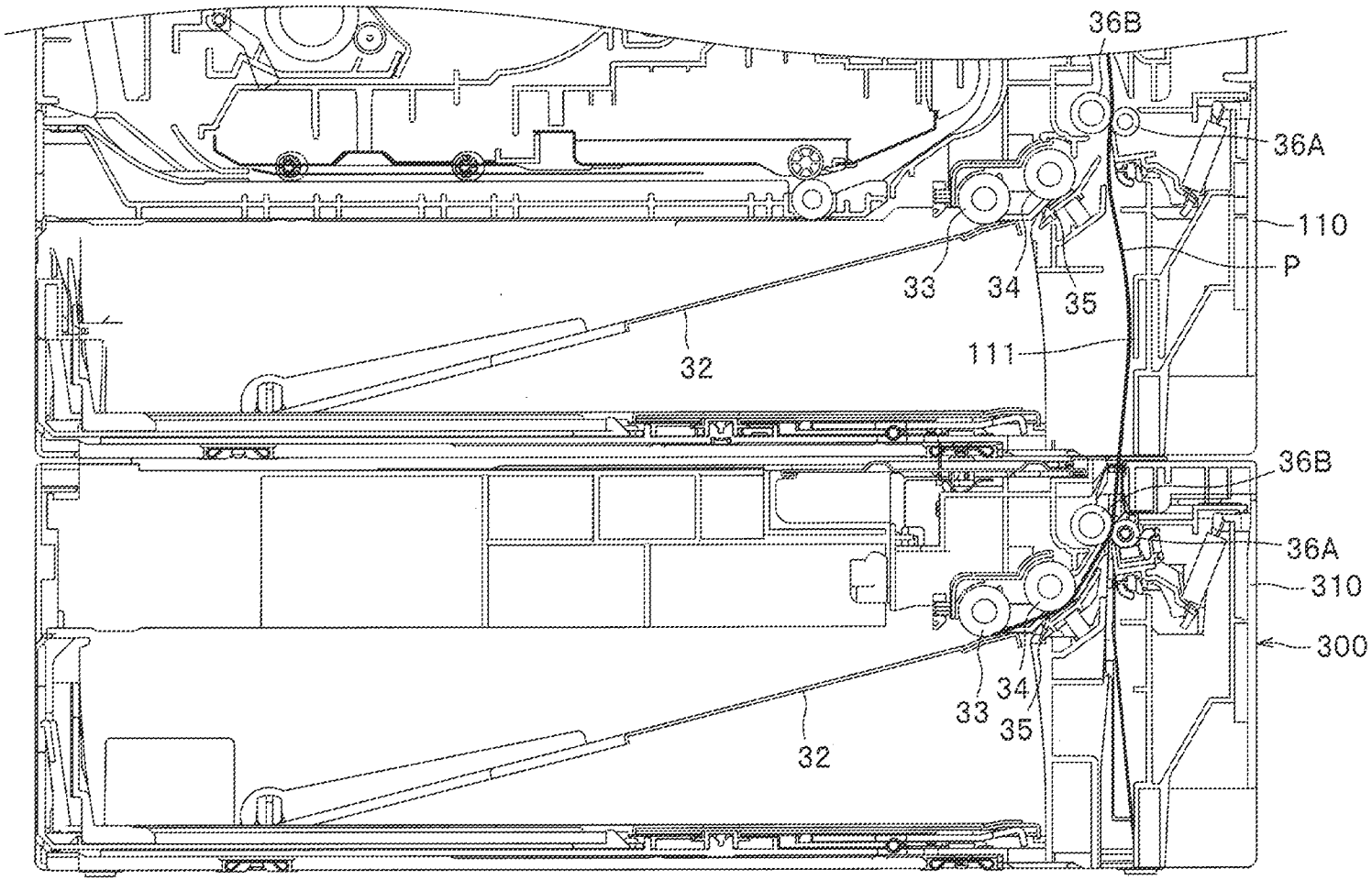
FIG. 3 is a sectional view of a lower part of the laser printer of FIG. 2A to which an add-on sheet feeder is attached.

That is, the laser printer 100 comprises the larger-capacity sheet feed tray 110, the pair of body frames 21, and the pair of expansion members 200. The body frames 21 are disposed on opposite sides of the larger-capacity sheet feed tray 110 with sandwiching an upper part of the larger-capacity sheet feed tray 110 therebetween. The body frames 21 are made of resin material. The expansion members 200 are disposed on opposite sides of the larger-capacity sheet feed tray 110 with sandwiching a lower part of the larger-capacity sheet feed tray 110 therebetween. The laser printer 100 comprises other units or portions, e.g., image forming unit 4 and top panel 22, of the laser printer 1, other than the sheet feed tray 31 for the laser printer 1. In the laser printer 100, as shown in FIG. 3, an add-on sheet feeder 300, e.g., add-on mechanism or sheet feeder, is additionally disposed under the pair of expansion members 200 and the larger-capacity sheet feed tray 110. It is appreciated that a unitary body frame or three or more body frames may be used that at least partially surrounds the upper part of the larger-capacity sheet feed tray 110. Likewise, it is appreciated that a unitary expansion member or three or more expansion members may at least partially surround a lower part of the larger-capacity sheet feed tray 110.

The larger-capacity sheet feed tray 110 is deeper than the sheet feed tray 31 (see FIG. 2B) and is configured to accommodate more sheets P than the sheet feed tray 31. The larger-capacity sheet feed tray 110 is configured to be attachable and detachable with respect to the expansion members 200 in the front-rear direction. The larger-capacity sheet feed tray 110 has substantially the same configuration, such as the pressing plate 32, the separation pad 35 and the paper dust removing roller 36A disposed in the sheet feed tray 31. In FIG. 3, the common parts are labeled with the same reference numerals as those shown in FIG. 1, and an explanation will be omitted for the common parts. For the sake of convenience, a state of the pressing plate 32 shown in FIGS. 1 and 3 refers to both states before the pressing plate 32 is pivoted from position and after the pressing plate 32 is returned to the position.

Figure 6:
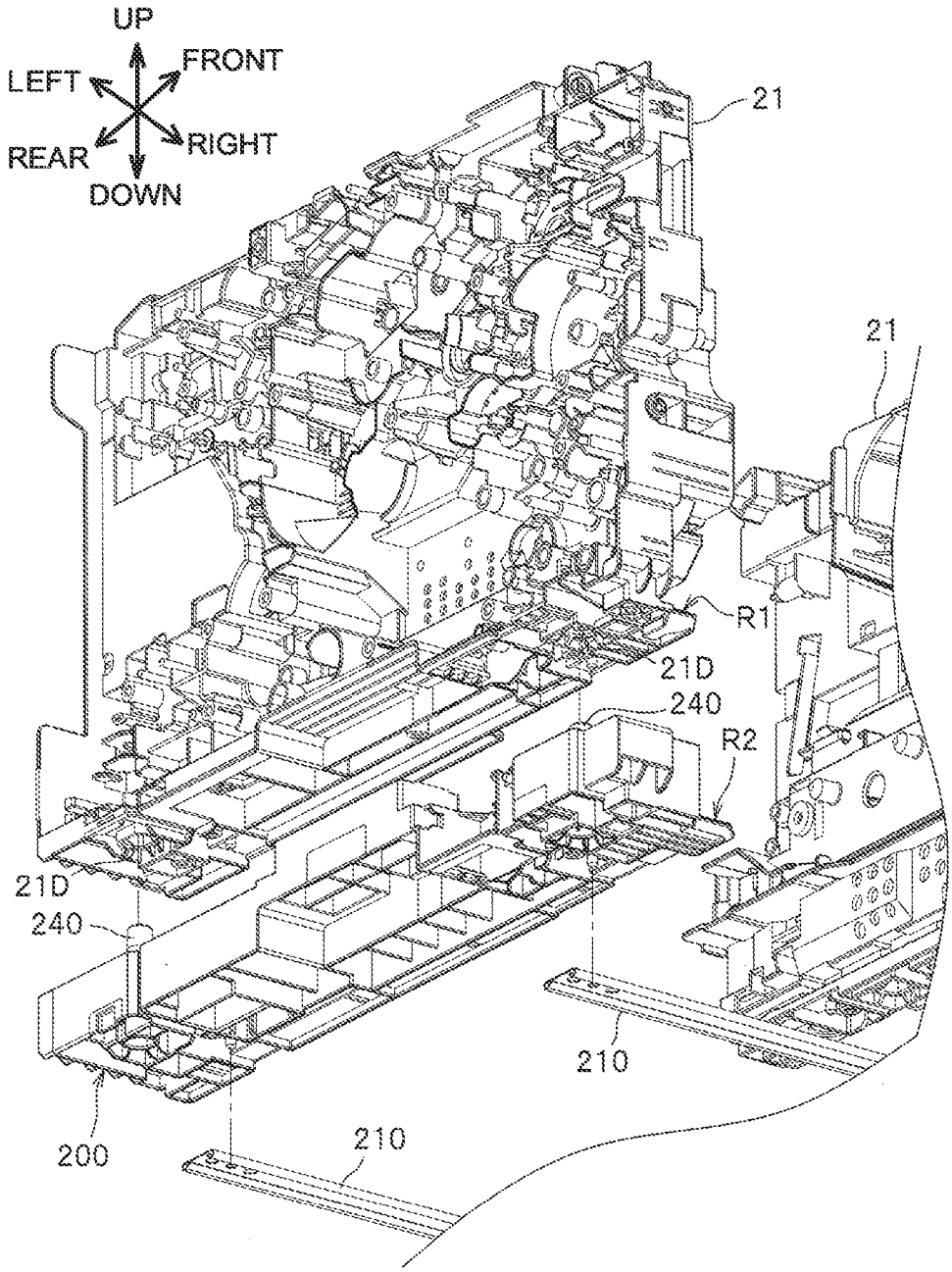
FIG. 6 is a perspective view showing a body frame, the pair of expansion members, and the under bars, which are disassembled, of the laser printer of FIG. 2A.

As shown in FIG. 6, each of the body frames 21 comprises a first rail R1 that extends in the front-rear direction in the lower part thereof. The sheet feed tray 31 is configured to be attachable to and detachable from the main body 2 in the front-rear direction while being guided on the first rails R1 of the body frames 21. Each of the expansion members 200 comprises a second rail R2 that extends in the front-rear direction in the lower part thereof. The larger-capacity sheet feed tray 110 is configured to be attachable to and detachable from the main body 2 in the front-rear direction while being guided on the second rails R2 of the expansion members 200.

With this configuration, the body frames 21 can be commonly used for the sheet feed tray 31 and for the larger-capacity sheet feed tray 110. That is, when the sheet feed tray 31 (e.g., maximum capacity: 250 sheets) is demanded to be used, only the pair of body frames 21 is used. When the larger-capacity sheet feed unit 110 (e.g., maximum capacity: 500 sheets) is demanded to be used, the pair of expansion members 200 and the pair of body frames 21 are used in combination.

Figure 4:
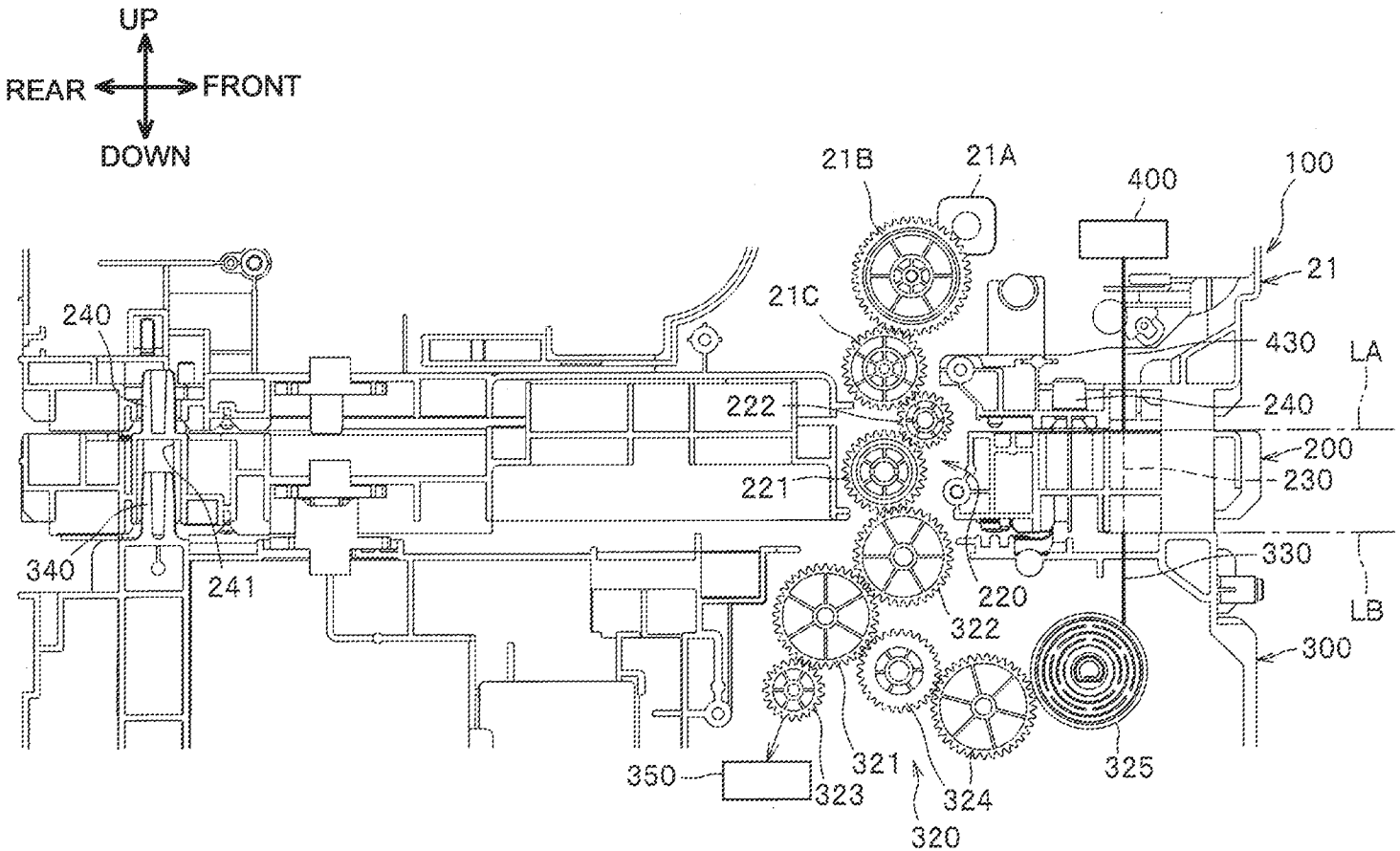
FIG. 4 is a sectional view of a transmission mechanism of the laser printer of FIG. 2A.

As shown in FIG. 4, one of the body frames 21 comprises a motor 21A, e.g., drive source, and a body-side gear 21C, to which a drive force is transmitted from the motor 21A via a gear 21B. The drive force from the motor 21A is transmitted to one or more mechanisms, e.g., photosensitive drum 61, provided in the main body 2 via gears (not shown). In FIG. 4, for the sake of convenience, a border between the body frame 21 and the expansion member 200 is indicated by a first boundary line LA and a border between the expansion member 200 and the add-on sheet feeder 300 is indicated by a second boundary line LB.

The body-side gear 21C is disposed slightly above the bottom surface of the body frame 21 (see the first boundary line LA). Therefore, when the laser printer 100 is placed on, for example, a floor, without the pair of expansion members 200 attached as shown in FIG. 2B, this configuration prevents interference of the body-side gear 21C with the floor surface.

Figure 5:
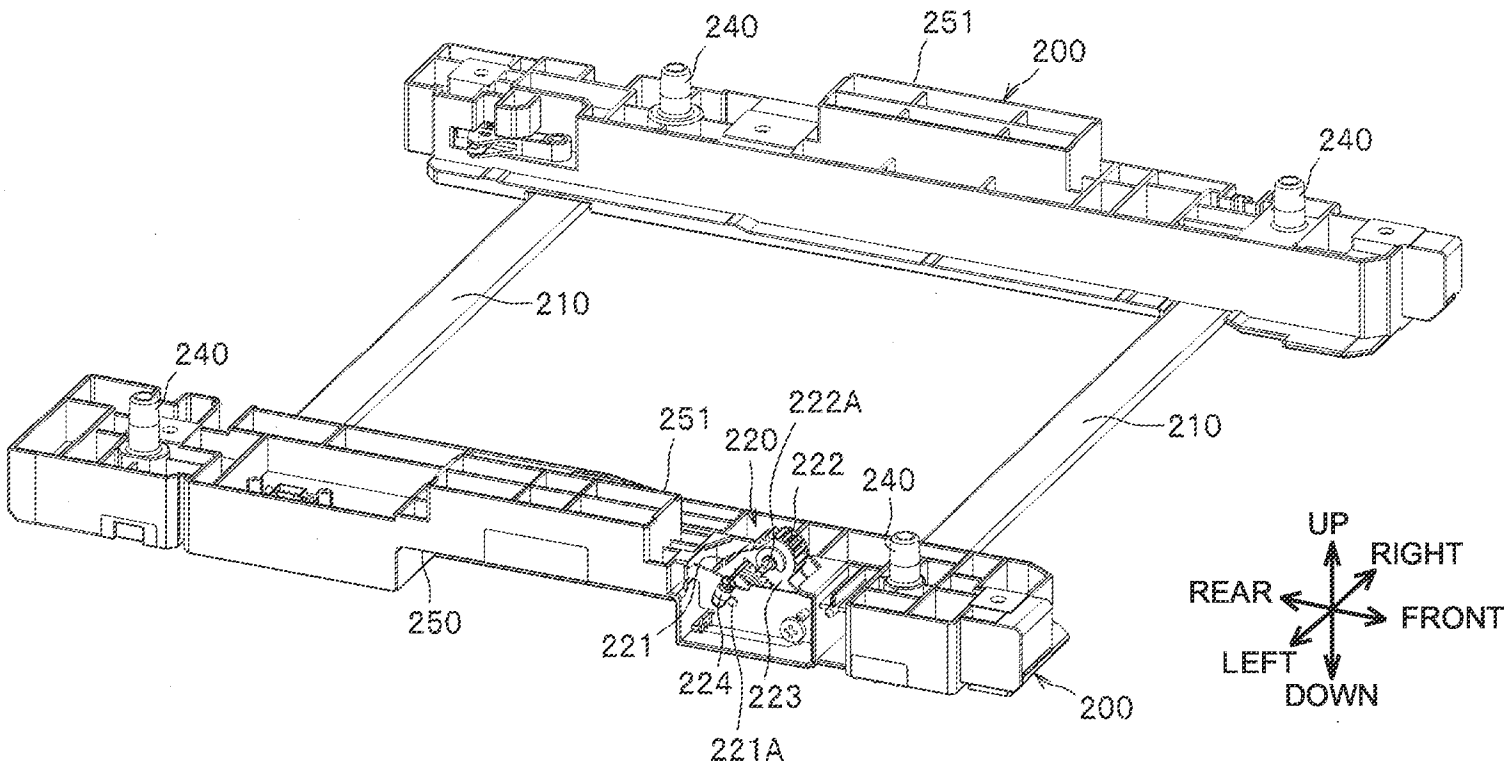
FIG. 5 is a perspective view showing a pair of expansion members connected with each other by under bars.
Figure 7:
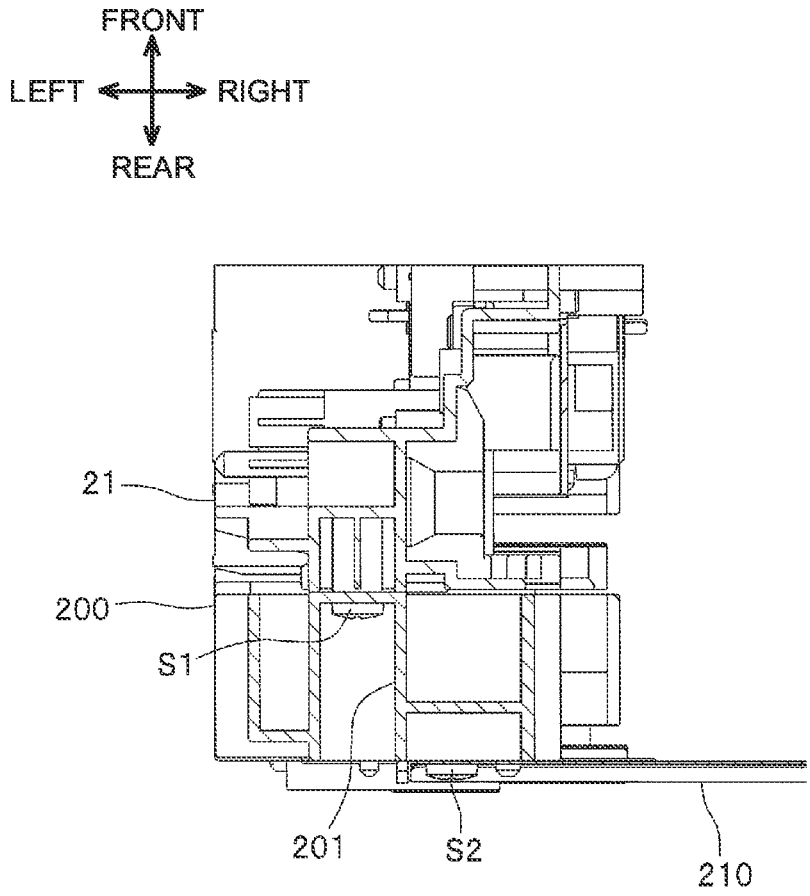
FIG. 7 is a sectional view showing a connecting configuration of the body frame and one of the expansion members in the laser printer of FIG. 2A.
Figure 8:
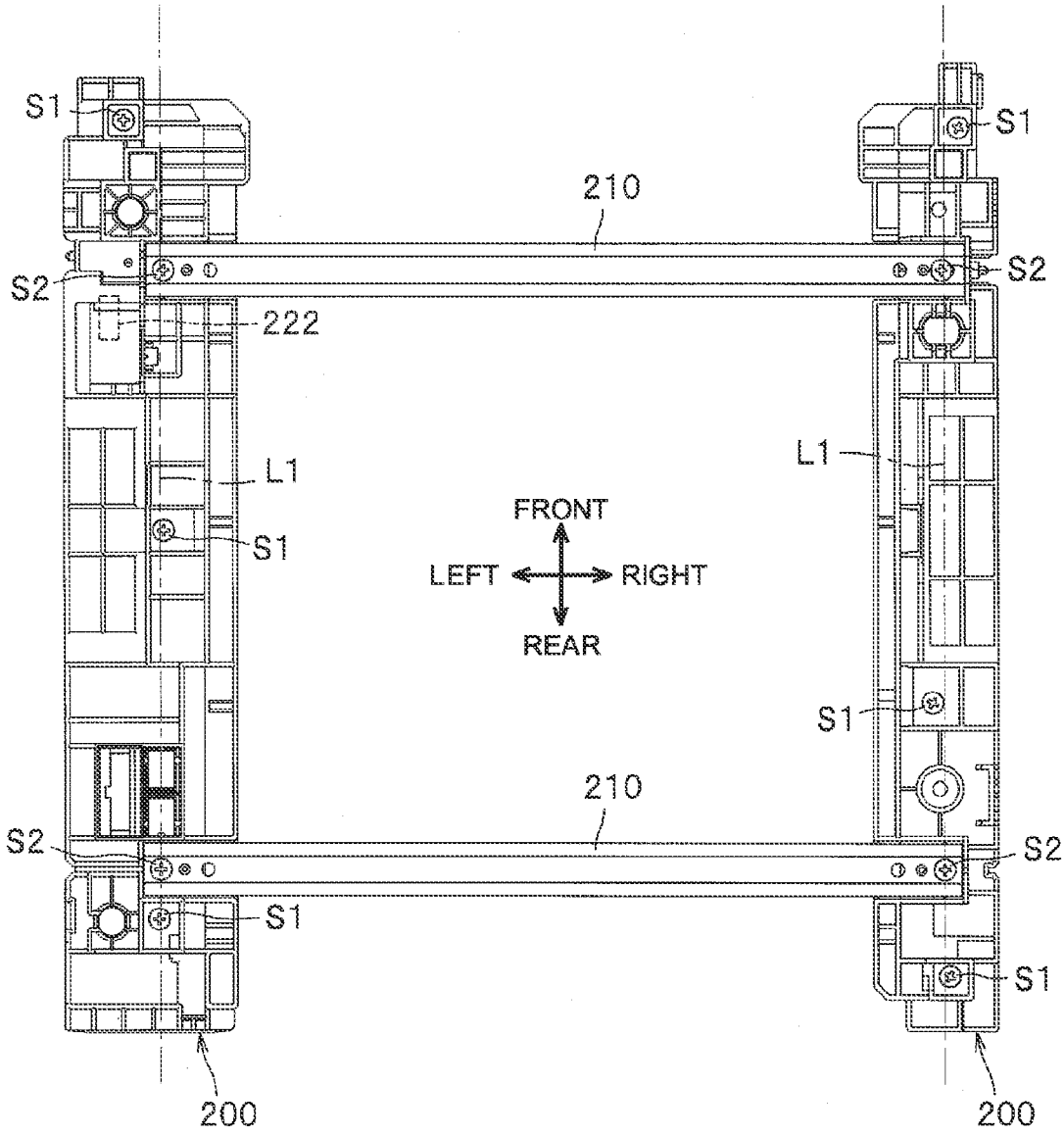
FIG. 8 is a bottom view of the pair of expansion members connected with each other by the under bars.

As shown in FIG. 5, the expansion members 200 include elongated members that extend in the front-rear direction. The expansion members 200 are connected with each other by a plurality of, e.g., two, under bars 210, which are spaced apart from each other in the front-rear direction (in an attaching-detaching direction of the larger-capacity sheet feed tray 110). Under this condition, the pair of expansion members 200 is attached to the pair of body frames 21. More specifically, as shown in FIGS. 7 and 8, the body frames 21 and the expansion members 200 are joined to each other with first screws S1. The two under bars 210, which are bridged between the expansion members 200, are joined to the bottom of each of the expansion members 200 with second screws S2. Because the body frames 21 and the expansion members 200 are joined to each other with the first screws S1, the swaying of the body frames 21 with respect to the expansion members 200 may be reduced. The pair of expansion members 200 are connected with each other by the two under bars 210. Thus, this configuration may reduce the individual swaying of the body frames 21 in directions that move closer to and away from each other.

As shown in FIG. 7, each of the expansion members 200 has recesses 201 which are upwardly recessed. In each recess 201, the first screw S1 connects the expansion member 200 and the corresponding body frame 21 at an upper end of the recess 201. The second screw S2 connects the expansion member 200 and the under bar 210 at the bottom of the expansion member 200.

As shown in FIG. 8, a plurality of first screws S1 are used for each of the expansion members 200. A phantom line L1, which extends in a direction parallel to the attaching-detaching direction of the larger-capacity sheet feed tray 110 (the front-rear direction) and passes through the center of the rear second screw S2, is provided. The plurality of first screws S1 are disposed on a first side and a second side of the phantom line L1, in which the first side refers to a side that is near the image forming unit 4 with respect to the phantom line L1 and the second side refers a side that is the opposite side and is far from the image forming unit 4 with respect to the phantom line L1. More specifically, the plurality of first screws S1 are arranged such that their centers are positioned on both the right and left of the phantom line L1.

With this configuration, the first screws S1 arranged on the right and left of the phantom line L1 may surely reduce the swaying of the expansion members 200 if the expansion members 200 are shook against the under bars 201 with respect to the phantom line L1.

Two each of the second screws S2 are provided to each of the expansion members 200. The two second screws S2 are positioned on the phantom line L1 in each of the expansion members 200. More specifically, the front second screw S2 is located such that a part of the front second screw S2 overlaps the phantom line L1 in each of the expansion members 200. With this configuration, the two under bars 210 are used as common parts. The common use of the under bars 210 may facilitate manufacture of the under bars 210.

The two adjacent first screws S1 arranged in the front-rear direction, e.g., two adjacent first screws S1 (front and intermediate first screws S1) disposed at the forward part of the left expansion member 200, are disposed in front of and behind the second screw S2 (on one side and the other side of the second screw S2 in the attaching-detaching direction). With this arrangement, the second screw S2 is sandwiched between the first screws S1 disposed in the front-rear direction and this configuration may prevent the expansion member 200 from separating from the body frame 21.

All of the first screws S1 are arranged adjacent to the phantom line L1 in each of the expansion members 200. In particular, the two first screws S1, e.g., the intermediate and rear first screws S1 disposed on the left expansion member 200 overlap the phantom line L1 in the left expansion member 200, and the rear first screw S1 disposed on the right expansion member 200 overlaps the phantom line L1 in the right expansion member 200.

More first screws S1 are disposed on the second side than the first side with respect to the phantom line L1 in each of the expansion members 200. Therefore, when force is applied to the body frames 21 from the second side in the right-left direction with respect to the phantom line L1, this arrangement may reduce a tendency that the body frames 21 lean inward with respect to the expansion members 200 as compared with a configuration in which the same number of the first screws S1 are provided and more first screws S1 are disposed on the first side than the second side with respect to the phantom line L1 in each of the expansion members 200.

The front and intermediate first screws S1 are disposed in front of and behind a swing gear 222 (see FIG. 5), which is disposed at a position nearest to the body frame 21 than other parts in a transmission mechanism 220 (described later). With this configuration, deformation of the frame surrounding the swing gear 222 may be reduced by the first screws S1. Thus, the swing gear 222 and the body-side gear 21C (see FIG. 4) may be surely engaged with each other.

As shown in FIGS. 4 and 5, one of the expansion members 200 comprises the transmission mechanism 220. The transmission mechanism 220 is configured to be engageable with the body-side gear 21C. With this engagement, the transmission mechanism 200 is configured to transmit a drive force, which is transmitted from the motor 21A via the gear 21B and the body-side gear 21C, to the add-on sheet feeder 300, which is attached under the expansion members 200. With this configuration, the drive force from the motor 21A disposed in the one of the body frames 21 can be transmitted to the add-on sheet feeder 300 via the gear 21B, the body-side gear 21C, and the transmission mechanism 220. Therefore, the mechanisms in the one of the body frames 21 and the add-on sheet feeder 300 can be driven by the common motor 21A.

More specifically, the transmission mechanism 220 comprises a central gear 221, the swing gear 222, and a swing arm 223. The swing gear 222 is engaged with the central gear 221 and is configured to rotate while swinging about the central gear 221. The swing arm 223 connects a rotational shaft 221A of the central gear 221 and a rotational shaft 222A of the swing gear 222 with each other. The rotational shaft 222A extends through the rotational center of the swing gear 222. In this embodiment, the rotational shaft 222A passes through an opening formed in the center of the swing gear 222 and both ends of the rotational shaft 222A are fixed to the swing arm 223 by clamping.

The swing gear 222 (more specifically, the rotational shaft 222A of the swing gear 222) is urged by a coil spring 224 such that the swing gear 222 protrudes upward from the upper surface of the expansion member 200, when the expansion member 200 is separated from the body frame 21.

With this configuration, when the expansion member 200 is attached to the corresponding body frame 21, the swing gear 222 is swung by which the movement of the rotational shaft 222A is stopped by interference of the rotational shaft 222A of the swing gear 222, which is disposed higher than the upper surface of the expansion member 200, with the body frame 21. Therefore, a pitch between the swing gear 222 and the body-side gear 21C may be adjusted.

The one of the expansion members 200 comprises a current-carrying member 230 configured to transmit power from the body frame 21 to the add-on sheet feeder 300. More specifically, an upper end of the current-carrying member 230 is connected with a body-side current-carrying member 430, which is connected with a control unit 400 disposed in the body frame 21, and a lower end thereof is connected with a feeder-side current-carrying member 330, which is connected an electromagnetic clutch 325 (described later) disposed in the add-on sheet feeder 300. The control device 400 is connected with an external power source via a wiring (not shown).

With this configuration, the electromagnetic clutch 325 of the add-on sheet feeder 300 can be controlled by the control unit 400 disposed in the body frame 2. Therefore, the common use of the control unit 400 may reduce costs. Each of the current-carrying members 230, 330, 430 may comprise, for example, two terminal and a harness, or may be made by a printed wiring board.

As shown in FIG. 6, each of the body frames 21 and each of the expansion members 200 comprise two body-side recesses 21D and two expander-side protrusions 240, respectively, to position the expansion members 200 with respect to the corresponding body frames 21. The body-side recesses 21D have a circular shape. One of the body-side recesses 21D is disposed at the forward part of the bottom surface of each of the body frames 21 and the other is disposed at the rearward part of the bottom surface of each of the body frames 21.

The expander-side protrusions 240 have a substantially cylindrical shape. One of the expander-side protrusions 240 is disposed at the forward part of the top of each of the expansion members 200 and the other is disposed at the rearward part of the top of each of the expansion members 200 such that the expander-side protrusions 240 are positioned coaxially with the corresponding body-side recesses 21D. As shown in FIG. 4, the expander-side protrusions 240 protrude upward than the transmission mechanism 220.

The body-side gear 21C and the transmission mechanism 220 are disposed between the expander-side protrusions 240 in the front-rear direction. With this arrangement, if the expansion member 200 is inclined in a direction that is separated from the one of the expander-side protrusions 240 with respect to the other of the expander-side protrusions 240 when the expansion member 200 is attached to the corresponding body frame 21, the transmission mechanism 220 does not contact the body frame 21. Therefore, damage to the transmission mechanism 220 may be reduced.

The body-side gear 21C and the transmission mechanism 220 are disposed near the front expander-side protrusion 240. Accordingly, the transmission mechanism 220 may be joined to the body-side gear 21C precisely.

As shown in FIG. 4, each of the expansion members 200 and the add-on sheet feeder 300 comprise two expander-side recesses 241 and feeder-side protrusions 340, respectively, to position the add-on sheet feeder 300 with respect to the expansion members 200. The expansion-side recesses 241 have a circular shape and the same diameter as the body-side recesses 21D. One of the expander-side recesses 241 is disposed at the forward part of the bottom surface of each of the expansion members 200 and the other is disposed at the rearward part of the bottom surface each of the expansion members 200 such that the expander-side recesses 241 are positioned coaxially with the corresponding expander-side protrusions 240 (only one of the expansion-side recesses 241 and one of the feeder-side protrusions 340 are shown in FIG. 4).

The feeder-side protrusions 340 have a substantially cylindrical shape and the same diameter as the expander-side protrusions 240. For example, four feeder-side protrusions 340 are positioned coaxially with the corresponding expander-side recesses 241. Two each of the feeder-side protrusions 342 are disposed at the forward part and rearward part of the add-on sheet feeder 300 (only one of the feeder-side protrusions 340 is shown in FIG. 4). Accordingly, the add-on sheet feeder 300 may be positioned with respect to the expansion members 200 and with respect to the body frames 21.

The feeder-side protrusions 340 protrude upward than the swing gear 322 of a feeder-side transmission mechanism 320 (described later). The transmission mechanism 220 and the swing gear 322 are disposed between two feeder-side protrusions 340, more specifically, near the forward feeder-side protrusion 340. Accordingly, damage to the swing gear 322 may be prevented or reduced and the swing gear 322 may be engaged with the transmission mechanism 220 and the body-side gear 21C precisely.

Figure 9:
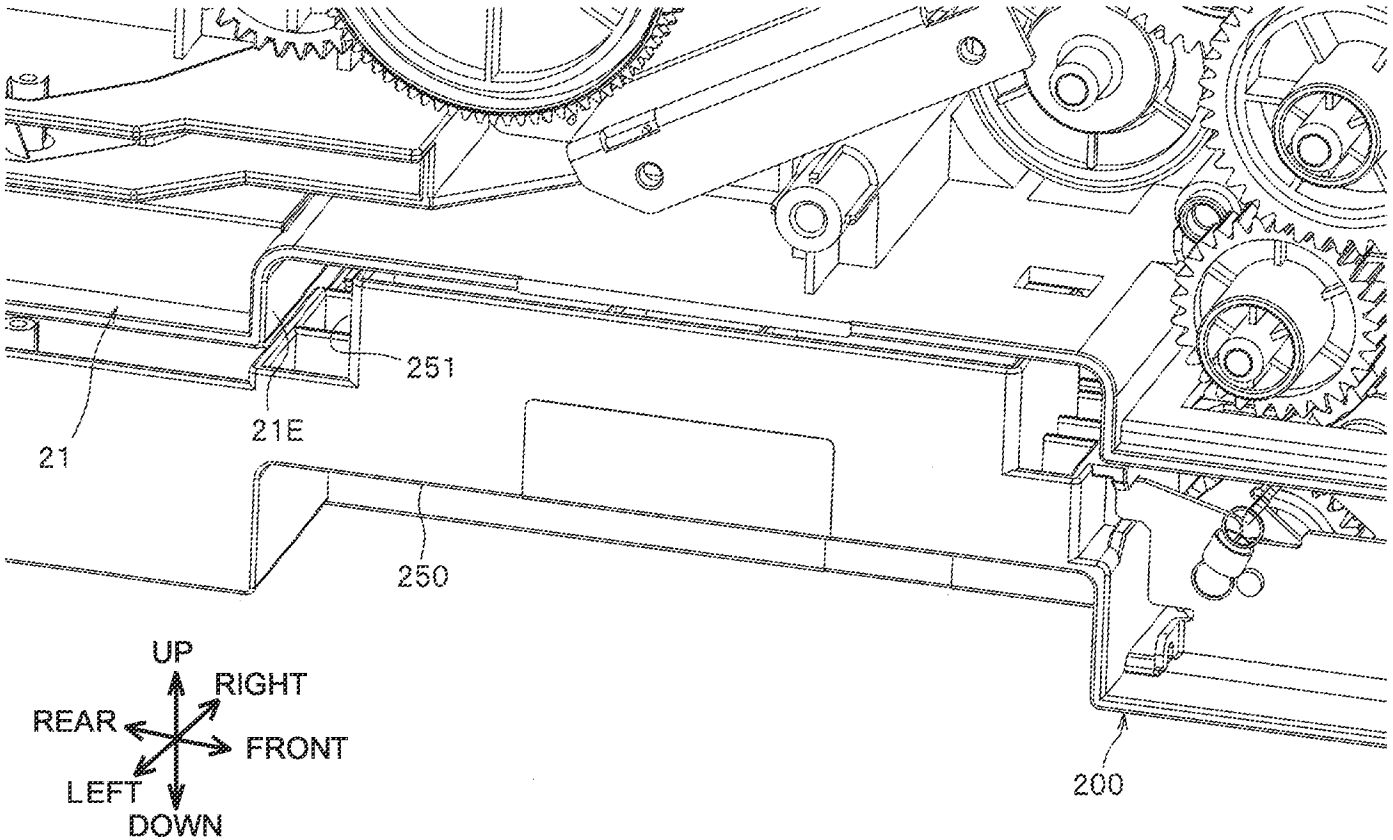
FIG. 9 is an enlarged perspective view of a hand well of the body frame and a hand well of the expansion member.

As shown in FIG. 5, each of the expansion members 200 is provided with a hand well 250 at a lowermost portion thereof. A user may put his/her hands on the hand wells 250 to carry the laser printer 100. Each of the hand wells 250 is recessed upward and inward in the right-left direction. As shown in FIG. 9, the hand well 250 is formed at a position that corresponds to a body-side hand well 21E, which is a recess formed at a lowermost portion of the body frame 21. Another hand well 250 is formed in the same manner.

More specifically, a projecting portion 251 projects upward from the upper portion of each of the hand wells 250. The projecting portion 251 has an appropriate size such that the projecting portion 251 enters the body-side hand well 21E and the top of the projecting portion 251 is positioned adjacent to an upper surface of the body-side hand well 21E.

With this configuration, the user may carry the laser printer 100 with having the same balance as when the user carries the laser printer 1 comprising the smaller-capacity sheet feed tray 31.

As shown in FIG. 3, the add-on sheet feeder 300 comprises a second sheet feed tray 310, e.g., second tray, and the pressing plate 32, the feed roller 33, the separation roller 34, the separation pad 35, the paper dust removing roller 36A and the conveyor roller 36B, which are the same as those disposed in the larger-capacity sheet feed tray 110. More specifically, the second sheet feed tray 310 is configured to accommodate therein one or more sheets P and be attachable to and detachable from the add-on sheet feeder 300 in the front-rear direction. The pressing plate 32, the separating pad 35, the paper dust removing roller 36A are disposed in the second sheet feed tray 310. The feed roller 33, the separation roller 34, and the conveyor roller 36B are disposed in the add-on sheet feeder 300 (its housing configured to support the second sheet feed tray 310).

The add-on sheet feeder 300 is configured to feed a sheet P to the image forming unit 4 from the second sheet feed tray 310 by conveying the sheet P upward using the rollers 33, 34, 36A, 36B of the add-on sheet feeder 300 via the paper dust removing roller 36A and the conveyor roller 36B of the larger-capacity sheet feed tray 110. More specifically, the larger-capacity sheet feed tray 110 comprises a conveyance guide 111, which is disposed near a front wall of the larger-capacity sheet feed tray 110 to guide the sheet P being conveyed. Sheets P stacked in the second sheet feed tray 310 of the add-on sheet feeder 300 are conveyed one by one to the paper dust removing roller 36A and the conveyor roller 36B of the larger-capacity sheet feed tray 110 through the conveyance guide 111.

As shown in FIG. 4, the add-on sheet feeder 300 comprises the feeder-side transmission mechanism 320. The feeder-side transmission mechanism 320 is configured to be engagable with the transmission mechanism 220 and transmit the drive force from the motor 21A to the feed roller 33. Therefore, the feed roller 33 may be driven without another motor provided in the add-on sheet feeder 300.

The feeder-side transmission mechanism 320 is connected with a drive mechanism 350, which is configured to move the pressing plate 32 up and down. Therefore, the pressing plate 32 of the add-on sheet feeder 300 may be driven by the motor 21A of the one of the body frames 21.

More specifically, the feeder-side transmission mechanism 320 comprises a central gear 321 and a swing gear 322, which have substantially the same structure as the central gear 221 and the swing gear 222 of the transmission mechanism 220. The feeder-side transmission mechanism 320 further comprises gears 323 (only one of which is shown in FIG. 4), gears 324, and an electromagnetic clutch 325. The gears 323 are provided to transmit a drive force from the central gear 321 to the drive mechanism 350. The gears 324 and the electromagnetic clutch 325 are provided to transmit a drive force from the central gear 321 to the feed roller 33.

The electromagnetic clutch 325 is controlled by the control unit 400 of the one of the body frame 21. By this control, the drive force of the motor 21A is supplied to the feed roller 33 or stopped supplying to the feed roller 33.

While the invention has been described in detail with reference to the specific embodiment thereof, it would be apparent to those skilled in the art that various changes, arrangements and modifications may be applied therein without departing from the spirit and scope of the invention.

In the above-described embodiment, the image forming unit 4 comprising the scanner unit 5, the process cartridge 6, and the fixing unit 7 is adopted. However, the invention is not limited to the specific embodiment. For example, an image forming unit using an LED head, using a photosensitive belt, or using a heat roller, may be adopted.

In the above-described embodiment, sheets P, e.g., cardboards, postcards, thin paper, are adopted as an example of the recording sheet. However, the invention is not limited to the specific embodiment. For example, overhead transparency films may be adopted as the recording sheet.

In the above-described embodiment, the add-on sheet feeder 300 is adopted as the add-on mechanism. However, the invention is not limited to the specific embodiment. For example, the add-on mechanism may be another pair of expansion members. That is, one or more pairs of expansion members 200 may be disposed under the above-described pair of expansion members 200 and the add-on sheet feeder 300 may be disposed under the lowermost pair of expansion members 200.

In the above-described embodiment, the swing gear 222 is swung by the swing arm 223 that connects the rotational shaft 221A of the central gear 221 and the rotational shaft 222A of the swing gear 222 with each other. However, the invention is not limited to the specific embodiment. For example, the swing gear 222 may be swung along an arc-shaped groove.

In the above-described embodiment, the body-side recesses 21D and the expander-side protrusions 240 are adopted as a positioning portion. However, the invention is not limited to the specific embodiment. For example, recesses may be provided in the expansion member 200, and protrusions may be provided on the body frame 2.

In the above-described embodiment, the one of the two body-side recesses 21D is disposed at the forward part of each of the body frames 21 and the other is disposed at the rearward part of each of the body frames 21. The one of the two expander-side protrusions 240 is disposed at the forward part of each of the expansion members 200 and the other is disposed a the rearward part of each of the expansion members 200. However, the invention is not limited to the specific embodiment. For example, only one each of the body-side recess 21D and the expander-side protrusion 240 may be provided, or three or more of the body-side recesses 21D and three or more of the expander-side protrusions 240 may be provided.

In the above-described embodiment, the two under bars 210 are provided and disposed at the forward part and rearward part of the expansion members 200. However, the invention is not limited to the specific embodiment. For example, a single under bar 210 may be disposed at the forward part of each of the expansion members 200 or at the central part of each of the expansion members 200.

In the above-described embodiment, the two adjacent first screws S1 in the front-rear direction are disposed in front of and behind the one second screw S2. However, the invention is not limited to the specific embodiment. For example, the two adjacent first screws S1 may be disposed in front of the second screw S2 only or behind the second screw S2 only.

In the above-described embodiment, the three first screws S1 are arranged in each of the expansion members 200 such that more first screws S1 are disposed on the second side than the first side with respect to the phantom line L1. However, the invention is not limited to the specific embodiment. The three first screws S1 may be arranged in each of the expansion members 200 such that more first screws S1 are disposed on the first side than the second side with respect to the phantom line L1.

In the above-described embodiment, the swing gear 222 and the rotational shaft 222A are provided as separate parts. However, the invention is not limited to the specific embodiment. The rotational shaft 222A may be integral with the swing gear 222. In the above-described embodiment, the rotational shaft 222A is made in contact with the body frame 21. However, the invention is not limited to the specific embodiment. The configuration may be changed such that a body frame restricts the movement of a shaft portion that passes through the center of rotation a the swing gear. For example, the movement of the shaft portion may be restricted by contact between a bearing, which rotatably supports the shaft portion of the swing gear, and the body frame.

In the above-described embodiments, the various aspects of the invention are described in relation to the laser printer 100. However, the invention is not limited to the specific embodiment. The invention may be adopted to other image forming apparatus, e.g., inkjet printing systems, copying machines, or multifunction peripherals.

What is claimed is:

1. An image forming apparatus comprising;

a first tray configured to accommodate one or more recording sheets to be supplied to an image forming unit;

a body frame configured to position an upper part of a first side of the first tray, the body frame including:

a drive source;

a body-side gear configured to receive a driving force from the drive source; and an expansion member disposed under the body frame and adjacent to the first tray to position a lower part of the first side of the first tray, the expansion member including:

a transmission mechanism configured to be engagable with the body-side gear, the transmission mechanism being configured to convey the driving force to an add-on mechanism, wherein the transmission mechanism comprises:

a central gear;

a swing gear configured to engage with the central gear and rotate while swinging about the central gear; and a shaft portion that passes through the center of rotation of the swing gear, wherein the body frame includes a pair of body frames of which one of the body frames includes the body-side gear, wherein the expansion member includes a pair of expansion members, and wherein the swing gear is swung by restriction of movement of the shaft portion by the pair of body frames when the pair of expansion members are attached to the pair of body frames and a pitch between the swing gear and the body-side gear is adjusted.

2. The image forming apparatus according to claim 1, wherein the body-side gear is disposed higher than a lower surface of the one of the pair of body frames, wherein one of the expansion members includes the transmission mechanism, and wherein the swing gear protrudes upward of an upper surface of the one of the pair of expansion members.

3. The image forming apparatus according to claim 1, wherein the expansion member further comprises a current-carrying portion configured to transmit power from the body frame to the add-on mechanism.

4. The image forming apparatus according to claim 1, wherein one of the expansion members includes the transmission mechanism, and wherein each of the pair of body frames and each of the pair of expansion members comprise at least two positioning portions configured to position the pair of expansion members with respect to the pair of body frames, and wherein the body-side gear and the transmission mechanism are disposed between the positioning portions.

5. The image forming apparatus according to claim 1, wherein the add-on mechanism is a sheet feeder unit disposed under the expansion member, the sheet feeder unit comprising:

a second tray configured to accommodate one or more recording sheets;

a feed roller configured to convey the one or more recording sheets from the second tray to the image forming unit; and a feeder-side transmission mechanism configured to be engaged with the transmission mechanism and transmit a drive force from the drive source to the feed roller.

6. The image forming apparatus according to claim 5, wherein the sheet feeder comprises:

a pressing plate configured to press the one or more recording sheets accommodated in the second tray against the feed roller; and a drive mechanism configured to move the pressing plate up and down, wherein the feeder-side transmission mechanism is connected with the drive mechanism.

7. The image forming apparatus of claim 1, wherein the body frame is configured to position the upper part of the first side of the first tray by contacting the upper part of the first side of the first tray, and wherein the expansion member is configured to position the lower part of the first side of the first tray by contacting the lower part of the first side of the first tray.

8. An image forming apparatus comprising;

a first tray configured to accommodate one or more recording sheets to be supplied to an image forming unit;

a body frame configured to position an upper part of the first tray; and an expansion member disposed under the body frame, the expansion member configured to position a lower part of the first tray, wherein the expansion member includes a transmission mechanism configured to be engagable with a body-side gear provided in the body frame, wherein the transmission mechanism is configured to transmit a drive force, which is transmitted from a drive source provided in the body frame via the body-side gear, to an add-on mechanism, which is attached under the expansion member, when the transmission mechanism is engaged with the body-side gear, and wherein the transmission mechanism comprises:

a central gear;

a swing gear configured to engage with the central gear and rotate while swinging about the central gear; and a shaft portion that passes through the center of rotation of the swing gear, wherein the body frame includes a pair of body frames of which one of the body frames includes the body-side gear, wherein the expansion member includes a pair of expansion members, and wherein the swing gear is swung by restriction of movement of the shaft portion by the pair of body frames when the pair of expansion members are attached to the pair of body frames and a pitch between the swing gear and the body-side gear is adjusted.

9. The image forming apparatus according to claim 8, wherein one of the pair of expansion members includes the transmission mechanism.

10. An image forming apparatus for use with a first tray configured to accommodate one or more recording sheets, the first tray being positioned by an expansion member with the expansion member including a transmission mechanism connected to an add-on mechanism which is configured to feed the recording sheets, the image formation apparatus comprising:

an image forming unit configured to receive the recording sheets from first tray; and a body frame configured to position an upper part of the first tray, the body frame including:

a drive source; and a body-side gear configured to receive a driving force from the drive source, wherein the transmission mechanism comprises:

a central gear;

a swing gear configured to engage with the central gear and rotate while swinging about the central gear; and a shaft portion that passes through the center of rotation of the swing gear, wherein the body frame includes a pair of body frames of which one of the body frames includes the body-side gear, wherein the expansion member includes a pair of expansion members, and wherein the swing gear is swung by restriction of movement of the shaft portion by the pair of body frames when the pair of expansion members are attached to the pair of body frames and a pitch between the swing gear and the body-side gear is adjusted.

11. An expansion system configured to be attachable to an image forming unit that is configured to form images on recording sheets, the image forming unit including a body frame, the body frame including a drive source and a body-side gear configured to receive a driving force from the drive source, the expansion system comprising:

an expansion member connectable to the body frame, the expansion member including a transmission mechanism configured to receive the driving force from the body-side gear and convey the driving force to an add-on mechanism;

a first tray configured to hold the recording sheets, the first tray including an upper part and a lower part, the upper part being configured to be positioned by the body frame and the lower part being configured to be positioned by the expansion member, wherein the recording sheets are configured to be fed out of the first tray by the add-on mechanism, and wherein the transmission mechanism comprises:

a central gear;

a swing gear configured to engage with the central gear and rotate while swinging about the central gear; and a shaft portion that passes through the center of rotation of the swing gear, wherein the body frame includes a pair of body frames of which one of the body frames includes the body-side gear, wherein the expansion member includes a pair of expansion members, and wherein the swing gear is swung by restriction of movement of the shaft portion by the pair of body frames when the pair of expansion members are attached to the pair of body frames and a pitch between the swing gear and the body-side gear is adjusted.

* * * * *